US009693919B2

(12) United States Patent
Berman

(10) Patent No.: US 9,693,919 B2
(45) Date of Patent: Jul. 4, 2017

(54) PATIENT TRANSPORT DEVICE WITH STRAP CONCEALMENT APPARATUS AND CORRESPONDING METHODS

(71) Applicant: Medline Industries, Inc., Mundelein, IL (US)

(72) Inventor: Emily Berman, Lombard, IL (US)

(73) Assignee: Medline Industries, Inc., Northfield, IL (US)

( * ) Notice: Subject to any disclaimer, the term of this patent is extended or adjusted under 35 U.S.C. 154(b) by 457 days.

(21) Appl. No.: 14/508,363

(22) Filed: Oct. 7, 2014

(65) Prior Publication Data

US 2016/0095777 A1 Apr. 7, 2016

(51) Int. Cl.
*A61G 7/10* (2006.01)
*A61G 7/00* (2006.01)

(52) U.S. Cl.
CPC ..... *A61G 7/1023* (2013.01); *A61G 7/1026* (2013.01); *A61G 7/1051* (2013.01); *A61G 7/1073* (2013.01); *A61G 7/1074* (2013.01)

(58) Field of Classification Search
CPC ..... A61G 7/10; A61G 7/013; A61G 7/1021; A61G 7/1023; A61G 7/1026; A61G 7/1027; A61G 7/1049; A61G 7/1051; A47C 27/002; A47C 27/08; A47C 27/081; A47C 27/10; A47C 31/00; A47C 31/08; A47C 31/10; A47C 31/105; A47G 9/02; A47G 9/0238; A47G 9/0246
USPC ..... 5/81.1 R, 89.1, 81.1 HS, 81.1 T, 83.1, 5/690, 703, 737, 738, 497–499
See application file for complete search history.

(56) References Cited

U.S. PATENT DOCUMENTS 5,495,874 A 3/1996 Heiman
5,920,929 A * 7/1999 Hensley ..... A61G 7/1023 5/485
7,210,176 B2 * 5/2007 Weedling ..... A61G 1/013 5/706
7,228,579 B2 6/2007 Tidwell
(Continued)

OTHER PUBLICATIONS

BeasyTrans ETS, Transport Systems by Alimed; Medline Catalog; http://www.medline.com/catalog/catalog.jsp; Unknown Publication date but believed to be prior to present application filing date.
(Continued)

*Primary Examiner* — Robert G Santos
(74) *Attorney, Agent, or Firm* — Philip H. Burrus, IV

(57) ABSTRACT

A patient transport device includes an inflatable torso support and one or more straps coupled to sides of the inflatable torso support. Each strap can be configured at least as a single loop. A strap concealment device can be coupled to the inflatable torso support to span a major face of the inflatable torso support. The strap concealment device can include a central panel spanning the major face and one or more side panels extending from a perimeter of the central panel. The one or more side panels can terminate at an edge distally disposed from the central panel at a bunch-gathering binding. The one or more side panels can be selectively foldable between a first position concealing the inflatable torso support and some or all of the one or more straps and a second position exposing the inflatable torso support and the one or more straps.

20 Claims, 12 Drawing Sheets

(56) References Cited

U.S. PATENT DOCUMENTS 7,243,382 B2 * 7/2007 Weedling ..... A61G 7/103 5/703
7,340,785 B2 * 3/2008 Weedling ..... A61G 7/1028 5/706
7,415,738 B2 * 8/2008 Weedling ..... A61G 7/103 5/710
7,591,029 B2 * 9/2009 Weedling ..... A61G 7/103 5/655.3
7,725,963 B2 * 6/2010 Johnson ..... A61G 7/1028 5/81.1 HS
7,739,758 B2 * 6/2010 Weedling ..... A61G 7/103 5/81.1 HS
7,849,533 B1 * 12/2010 Receveur ..... A47G 9/0246 5/497
7,900,299 B2 * 3/2011 Weedling ..... A61G 7/103 5/625
7,975,330 B2 * 7/2011 Receveur ..... A61G 7/05784 5/691
8,099,809 B2 * 1/2012 Tanaka ..... A47C 31/08 224/158
8,234,727 B2 * 8/2012 Schreiber ..... A61G 7/1026 5/703
8,555,440 B2 10/2013 Lewis
8,566,977 B2 * 10/2013 Davis ..... A61G 7/1028 5/626
8,898,835 B2 * 12/2014 Khan ..... A47G 9/04 5/482
9,456,944 B2 * 10/2016 Berg ..... A61G 7/1051
2002/0166168 A1 * 11/2002 Weedling ..... A61G 7/103 5/81.1 R
2003/0019037 A1 * 1/2003 Michaelis ..... A47G 9/02 5/497
2005/0028273 A1 * 2/2005 Weedling ..... A61G 7/103 5/81.1 R
2005/0034229 A1 * 2/2005 Weedling ..... A61G 7/103 5/81.1 R
2005/0034230 A1 * 2/2005 Weedling ..... A61G 7/103 5/81.1 R
2005/0076437 A1 * 4/2005 Johnson ..... A61G 7/1028 5/81.1 R
2005/0193496 A1 * 9/2005 Weedling ..... A61G 1/013 5/713
2005/0246834 A1 * 11/2005 Weedling ..... A61G 7/103 5/81.1 R
2005/0283905 A1 * 12/2005 Johnson ..... A61G 7/1028 5/81.1 R
2006/0000016 A1 * 1/2006 Weedling ..... A61G 7/1028 5/81.1 HS
2006/0037136 A1 * 2/2006 Weedling ..... G09F 3/00 5/81.1 HS
2006/0253976 A1 * 11/2006 Weedling ..... A61G 7/103 5/81.1 R
2009/0094743 A1 * 4/2009 Tanaka ..... A61G 7/0504 5/81.1 T
2011/0056017 A1 * 3/2011 Schreiber ..... A61G 7/1028 5/81.1 HS
2011/0072579 A1 * 3/2011 Receveur ..... A61G 7/05784 5/81.1 HS
2012/0210511 A1 * 8/2012 Davis ..... A61G 7/1028 5/81.1 R
2012/0260424 A1 10/2012 Agarwall
2013/0198956 A1 * 8/2013 Khan ..... A47G 9/0223 5/498
2014/0007347 A1 * 1/2014 Olson ..... A47G 9/0246 5/496
2014/0041114 A1 2/2014 Davis
2014/0075673 A1 3/2014 Weedling et al.
2015/0047121 A1 * 2/2015 Berg ..... A61G 7/1051 5/83.1
2015/0074903 A1 * 3/2015 Berg ..... A61G 7/1051 5/83.1
2016/0095777 A1 * 4/2016 Berman ..... A61G 7/1051 5/81.1 T

OTHER PUBLICATIONS

ComfortRise Patient Sling and Repositioning Sheet; Medline Catalog; http://www.medline.com/catalog/catalog.jsp; Unknown Publication date but believed to be prior to present application filing date.
Disposable Repositioning Patient Sling by EMR; Medline Catalog; http://www.medline.com/catalog/catalog.jsp; Unknown Publication date but believed to be prior to present application filing date.
Megamover Chair Transports by Little Rapids; Medline Catalog; http://www.medline.com/catalog/catalog.jsp; Unknown Publication date but believed to be prior to present application filing date.
Megamover Patient Lifts by Little Rapids; Medline Catalog; http://www.medline.com/catalog/catalog.jsp; Unknown Publication date but believed to be prior to present application filing date.
Megamover Portable Transport Units by Graham Medical Products; Medline Catalog; http://www.medline.com/catalog/catalog.jsp; Unknown Publication date but believed to be prior to present application filing date.
Reusable Repositioning Patient Sling by EMR; Medline Catalog; http://www.medline.com/catalog/catalog.jsp; Unknown Publication date but believed to be prior to present application filing date.

* cited by examiner

PATIENT TRANSPORT DEVICE WITH STRAP CONCEALMENT APPARATUS AND CORRESPONDING METHODS

BACKGROUND

Technical Field

This disclosure relates generally to transport devices, and more particularly to patient transport devices.

Background Art

Moving patients around a hospital or other healthcare facility can be a challenge. Patients are not rigid objects designed for easy lifting. Instead, they bend and contort and can be difficult to lift. This difficulty is compounded when the person is elderly, suffering from injury, or obese. When lifting is not performed properly, the patient can be injured.

Prior art patient transfer devices have been developed. Such devices generally come in one of two flavors: a flat mattress or a sling with complicated connectors and harnesses. The flat mattress can ease the lateral movement of a patient. However, it provides little help in lifting a patient, as lifting the mattress can cause the patient to slide off onto the floor.

Prior art devices using connectors for lifting facilitate vertical movement of the patient. However, the connectors of such devices are complex to use and can make lateral movement of the patient extremely difficult. Moreover, the connector schemes of these devices are frequently unsightly and include numerous connectors and straps that, when left exposed, can catch a patient's arms, legs, fingers, and toes. Navigating connection devices of some prior art patient transfer devices is not unlike trying to unknot the proverbial "rat's nest" of fishing line when it unspools in a tackle box. It is time consuming and tedious. It would be advantageous to have an improved patient transport device.

Figure 1:
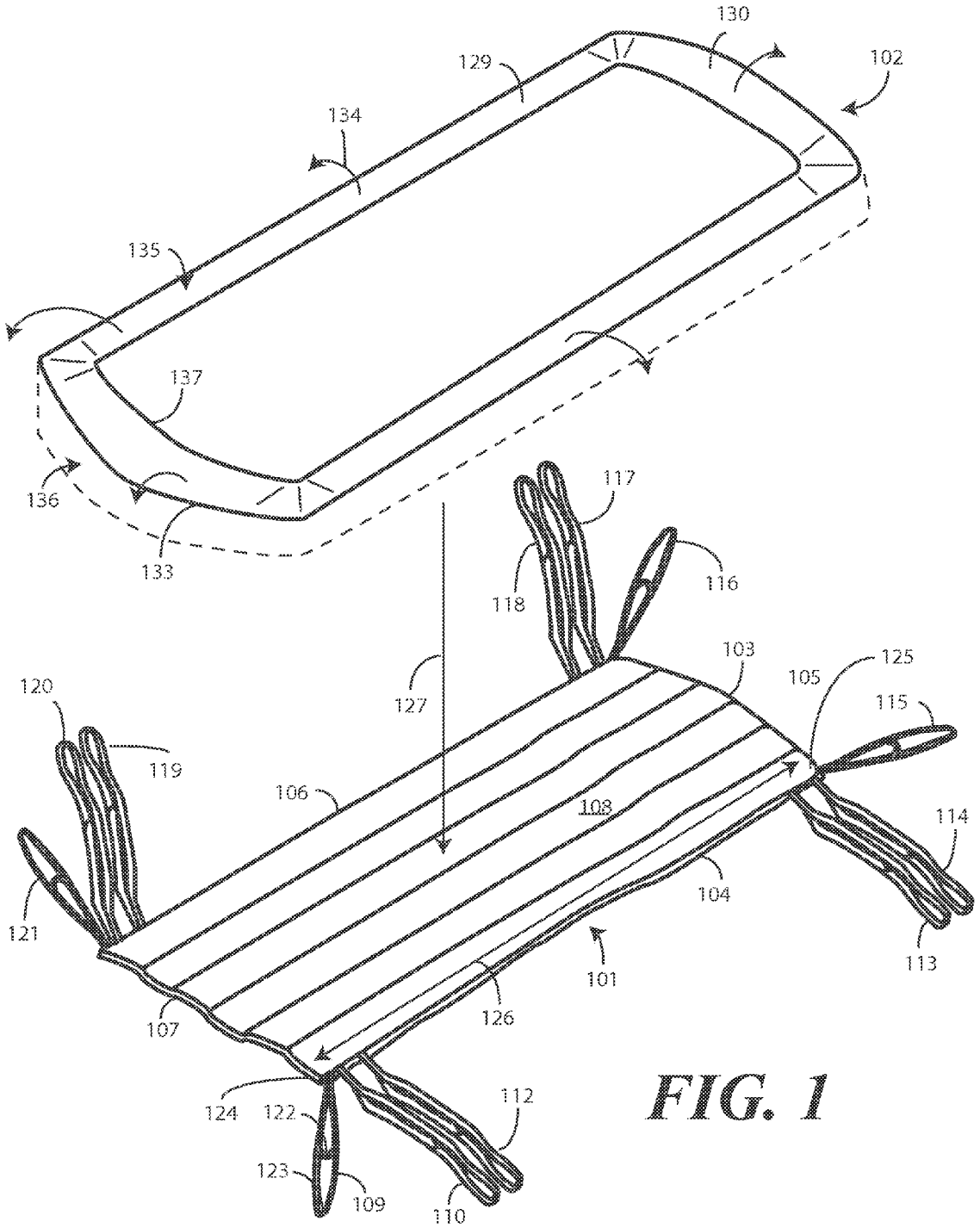
FIG. 1 illustrates one explanatory patient transport device in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A. Further, it is expected that one of ordinary skill, notwithstanding possibly significant effort and many design choices motivated by, for example, available time, current technology, and economic considerations, when guided by the concepts and principles disclosed herein will be readily capable of generating such patient transport devices and executing the methods described below with minimal experimentation.

Embodiments of the disclosure provide a patient transport device that can be used to transport a patient vertically, laterally, or combinations of the two. In one embodiment, the patient transport device includes an inflatable torso support. The inflatable torso support can be left uninflated when not in use. However, when it is desired to move a patient laterally, the inflatable torso support can be inflated. In one embodiment, the inflatable torso support works to reduce friction between the patient and the patient transport device so that the patient can be easily moved laterally from, for example, a bed to a gurney. While sealed in one embodiment, the inflatable torso support functions almost like an air hockey table does in that friction between the patient and the patient transport device is reduced.

In one embodiment, to assist in lifting the patient vertically, one or more straps are coupled to sides of the inflatable torso support. In one embodiment, the one or more loops are configured at least as a single loop. In some embodiments, multiple loops can be formed, with larger loops surrounding the smaller loops. Multiple loops advantageously allow the patient transport device to be used with a wide variety of lift equipment. Additionally, the loops can be used to transport a patient by hand as well.

While having multiple loops connected to sides of the inflatable torso support advantageously assist in more easily transporting a patient, large numbers of loops can present issues. To begin, they are sometimes unsightly for patients. Next, they can be uncomfortable to lie upon when they inadvertently become situated between the patient and the patient transport device. Third, the loops, when left exposed, can catch a patient's arms, legs, fingers, and toes. Finally, embodiments of the disclosure contemplate that the loops are needed for patient movement a minority of the time the patient transport device is in use.

To overcome theses issues, in or more embodiments the patient transport device advantageously includes a strap concealment device. In one embodiment, the strap concealment device is coupled to the inflatable torso support so as to span a major face of the inflatable torso support. For example, the strap concealment device can be coupled to the inflatable torso support so as to span the top surface of the inflatable torso support.

In one embodiment, the strap concealment device comprises a central panel that spans a major face of the inflatable torso support. The strap concealment device can also include one or more side panels that extend from a perimeter of the central panel and terminate at a bunch gathering binding. In one embodiment, the bunch gathering binding is an elastic gathering disposed about the terminating edges of the one or more side panels.

In one embodiment, the one or more side panels are selectively foldable. "Selectively" foldable means that a user can fold the one or more side panels between at least a first position and a second position. Thus, the user can place the one or more side panels in a first position for a first desired duration, and then can fold the one or more side panels to transition them to a second position for a second desired duration. It should be noted that the positions are not limited to two, i.e., a first position and a second position. In one or more embodiments, there may be three, four, five, ten, or more positions between which the one or more side panels are selectively foldable.

In one embodiment, the one or more side panels are selectively foldable between at least a first position and a second position. When the one or more side panels are in the first position, they are configured to conceal the inflatable torso support and at least a portion of the one or more straps. Where the one or more straps are folded beneath either the inflatable torso support or between the strap concealment device and the inflatable torso support, the one or more side panels can conceal all of the one or more straps when in the first position.

When in the second position, the one or more side panels expose the inflatable torso support and the one or more straps. Accordingly, the one or more straps can be attached to a lift device to move the patient as needed. When the inflatable torso support is not inflated, the patient transport device works like a sling in this embodiment, allowing the patient to be transported in either a sitting or reclined position.

Turning now to FIG. 1, illustrated therein is one example of a patient transport device 100 in accordance with one or more embodiments of the disclosure. In this embodiment, the patient transport device 100 includes an inflatable torso support 101. In one embodiment, the inflatable torso support 101 is configured as an inflatable mattress with a series of air chambers 103 disposed therein. The air chambers 103 may run transversely, laterally, or combinations of the two. In other embodiments, the air chambers 103 can be configured as individual pillow components that may be selectively—at once or individually—inflated as needed.

In one embodiment, the various air chambers 103 are interconnected at the interior of the inflatable torso support 101 so that all of the air chambers 103 can be inflated by an air source connected to a single port disposed along the inflatable torso support 101. This port (not shown) can be disposed at any of a number of locations along the inflatable torso support 101. In one or more embodiments, it is disposed along one of the edges of the inflatable torso support, such as at the sides 104,106 or ends 105,107 the inflatable torso support 101 so as to be accessible to a health care services provider when a patient is disposed along the top 108 of the inflatable torso support 101. In one or more embodiments, the port can be fitted with a pressure control device to ensure that the inflatable torso support 101 does not become over inflated. The pressure control device, where included, can also regulate the outflow of air when the inflatable torso support 101 is deflated so as to gently lower a patient onto a surface disposed beneath the inflatable torso support 101.

In one or more embodiments, a friction reducing coating can be disposed along, or integrated in, the outer surface of the inflatable torso support 101. For example, in one embodiment the exterior surface of the inflatable torso support 101 can be manufactured from a low-friction material such as nylon fibers or other synthetic fibers. Other low-friction materials include, for example, those manufactured from acrylic, nitrile, polyester, or rayon.

In other embodiments, the exterior of the inflatable torso support 101 can be coated with a non-stick coating, such as Teflon.sup.™ or another slippery coating. Accordingly, when a patient is disposed along the top 108 of the patient transport device 100 and the inflatable torso support 101 is inflated, lateral movement of the patient is simplified due to the friction reducing coating.

In one embodiment, one or more straps 109,110,112,113, 114,115,116,117,118,119, 120,121 are coupled to the sides 104,106 of the inflatable torso support 101. The one or more straps 109,110,112,113,114,115,116,117,118,119,120,121 can be coupled directly to the sides 104,106 in one embodiment. Alternate connection schemes will be described below with reference to FIG. 6. Still other connection schemes will be obvious to those of ordinary skill in the art having the benefit of this disclosure.

In one embodiment, each strap of the one or more straps 109,110,112,113,114,115, 116,117,118,119,120,121 can be configured as at least a single loop. In the illustrative embodiment of FIG. 1, each strap of the one or more straps 109,110,112,113,114,115,116, 117,118,119,120,121 is configured as double loops. For example, strap 109 includes first loop 122 and second loop 123. Accordingly, the at least one loop for strap 109 comprises two loops in this embodiment, with a first loop 122 disposed interior to a second loop 123. In other embodiments, each strap can be configured as three loops, four loops, or more loops, depending upon application. For example, in one embodiment the at least one loop comprising three loops, with a first loop disposed interior to a second loop and a third loop disposed interior to the first loop.

In one embodiment, each loop is color coded for use. For example the first loop 122 may be a first color, such as red, while the second loop 123 is another color, such as white. Color-coding the loops can advantageously provide a mnemonic device to a user regarding which loop is to be used for which purpose. Illustrating by example, the red color may be for hand carrying a patient, while the white color may be for machine lifting a patient, and so forth. By color-coding the loops, a user can instantly grab the proper loop with only a glance. Accordingly, in one or more embodiments, the first loop 122 and the second loop 123 are color-coded with the first loop 122 having a different color than the second loop 123. In other embodiments, each loop can have the same color.

In one embodiment, the one or more straps 109,110,112, 113,114,115,116,117,118, 119,120,121 are stitched to the sides 104,106 of the inflatable torso support 101. As noted above, other attachment techniques will be described below with reference to FIG. 6. However, where the one or more straps 109,110,112,113,114,115,116,117,118,119,120,121 are coupled directly to the inflatable torso support 101, they can be coupled by stitching in one embodiment. Other techniques can be used as well. For example, the one or more straps 109,110,112,113, 114,115,116,117,118,119,120, 121 can be clipped, snapped, riveted, or otherwise coupled to the inflatable torso support 101. Still other coupling techniques will be obvious to those of ordinary skill in the art having the benefit of this disclosure.

In one or more embodiments, the inflatable torso support 101 is configured in a substantially rectangular shape. Such is the case in the embodiment of FIG. 1. The inflatable torso support 101 is rectangular in shape when viewed in the top plan view. In one or more embodiments, the perimeter 133 of the strap concealment device 102 has a shape that is complementary to the shape of the inflatable torso support 101. Accordingly, if the inflatable torso support 101 is rectangular, so too will be the perimeter 133 of the central panel 128 of the strap concealment device 102 in one or more embodiments. It should be noted that the inflatable torso support 101 and/or perimeter 133 of the central panel 128 could be configured in any number of other shapes as well, including ovular, polygonal, free form, and other shapes depending upon application. For example, in one embodiment the inflatable torso support 101 and perimeter 133 of the central panel 128 are configured in an hourglass shape when viewed in the top plan view.

In the illustrative embodiment of FIG. 1, the one or more straps 109,110,112,113, 114,115,116,117,118,119,120,121 comprise a plurality of straps. In this embodiment, the straps 109,110,112,113,114,115,116,117,118,119,120,121 are positioned such that groups of three straps are positioned proximally at each corner of the substantially rectangular shape. For example, straps 109,110,112 are positioned proximally with corner 124. Similarly, straps 113,114,115 are positioned proximally with corner 125. As used herein, "proximally" means within a distance less than twenty percent of the length 126 of the patient transport device 100. Thus, if the length is six feet, the straps would be proximally located with the corners if they were within about fourteen and a half inches of the corner.

When the straps are placed proximally with the corners of the rectangular shape, the patient transport device 100 can advantageously cradle a patient when being lifted by the straps. This will be shown in more detail with reference to FIGS. 13-14 below. For example, where a patient's head is disposed toward one end 105 of the rectangular shape, and the patient's feet are disposed toward the other end 107, the placement of the straps 109,110,112,113,114,115,116, 117, 118,119,120,121 advantageously form a cradle for the patient's mid-section when the patient transport device 100 is lifted and/or moved.

The patient transport device 100 of FIG. 1 also includes a strap concealment device 102. In one embodiment, the strap concealment device 102 comprises a central panel 128 and one or more side panels 129,130,131,132 extending from a perimeter 133 of the central panel 128. In this embodiment, the one or more side panels 129,130,131,132 are contiguous. In other embodiments, the one or more side panels 129,130,131,132 may be separate from each other so as to define independent panels.

In one embodiment, the one or more side panels 129,130, 131,132 are foldable 134 between a first position 135, shown in FIG. 1 in solid line, and a second position 136, shown in FIG. 1 in dashed line. In one embodiment, the one or more side panels 129,130,131,132 terminate at a bunch-gathering binding 137. One example of a bunch-gathering binding 137 is an elastic-type material strip that is stitched to the terminating edge of the one or more side panels 129,130,131,132. Other examples of bunch-gathering bindings 137 include Lycra.sup.™, spandex, or elasticized yarns. Accordingly, when the one or more side panels 129,130,131,132 are folded from the first position 135 to the second position 136, the bunch-gathering binding 137 will expand as the terminating edge of the one or more side panels 129,130,131,132 pass about the perimeter 133 of the central panel 128. After this passage, the bunch-gathering binding 137 will apply a loading force to reduce a circumference of the terminating edge of the one or more side panels 129,130,131,132, thereby "bunching" this edge by causing the circumference to contract.

In one embodiment, the strap concealment device 102 is coupled 127 to the inflatable torso support 101 and spans a major face of the inflatable torso support 101. For example, in the embodiment of FIG. 1, the central panel 128 of the strap concealment device 102 spans the top 108 of the inflatable torso support 101 (the top 108 defines a major face of the inflatable torso support 101). When so attached, folding the one or more side panels 129,130,131,132 to the second position 136 will conceal the inflatable torso support 101. Conversely, folding the one or more side panels 129, 130,131,132 to the first position 135 will reveal the inflatable torso support 101.

In one embodiment, the strap concealment device 102 is configured to conform to the contours of the inflatable torso support 101 when inflated so as to fit snugly atop and along the sides of the inflatable torso support 101 when inflated.

In one embodiment, the strap concealment device 102 is made from an organic material such as a cotton weave. In other embodiments, the strap concealment device 102 is manufactured from a synthetic material, such as a polyester weave. In still other embodiments, the strap concealment device 102 is manufactured from a combination of organic and synthetic components.

In one or more embodiments, the strap concealment device 102 is manufactured to have the "feel" of a conventional bed sheet. It should be noted that feel might be a subjective element. However, embodiments of the disclosure contemplate that the majority of people prefer the feel of cotton when describing their desired bed sheet. Advantageously, cotton functions to keep a patient's skin dry, aids in comfort, and makes the patient feel more at home when lying atop cotton. Those in the industry may call the "feel" the "hand" of the material. Accordingly, in one embodiment, the strap concealment device 102 has the hand of cotton textiles.

The hand of cotton may include the incorporation of synthetic fibers to make the strap concealment device 102 more durable for laundering. For example, the wefts of the weave of the strap concealment device may be synthetic, while the warps of the weave are organic. Mixtures of organic and synthetic warps and weaves may be used to construct the strap concealment device 102 as well. Still other techniques will be obvious to those of ordinary skill in the art having the benefit of this disclosure.

Figure 2:
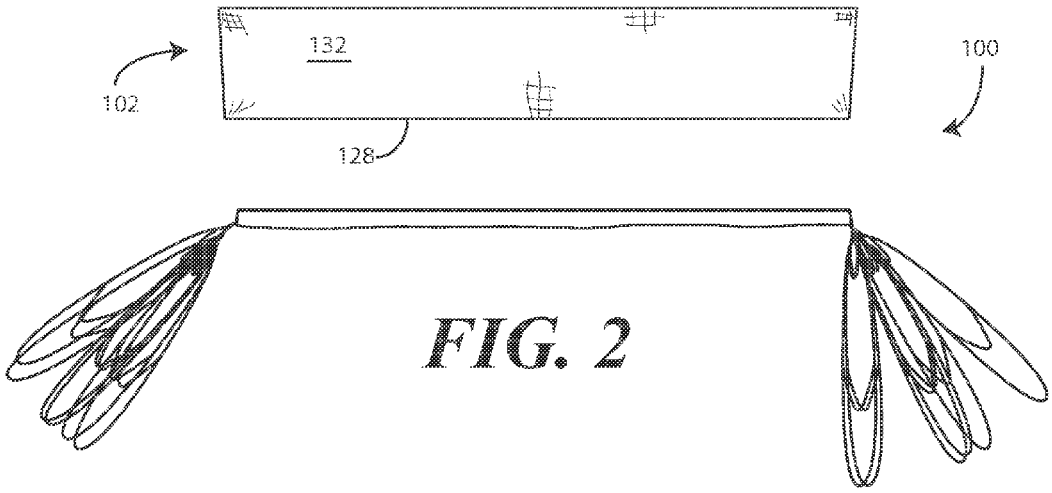
FIG. 2 illustrates one explanatory patient transport device in accordance with one or more embodiments of the disclosure.

Turning now to FIG. 2, illustrated therein is an end elevation view of the patient transport device 100. In this view, the strap concealment device 102 has its side panels (129,130,131),132 folded upward in a third position such that they extend vertically away from the central panel 128 of the strap concealment device 102. The view of FIG. 2 only serves to add clarity to the elements described above with reference to FIG. 1.

Figure 3:
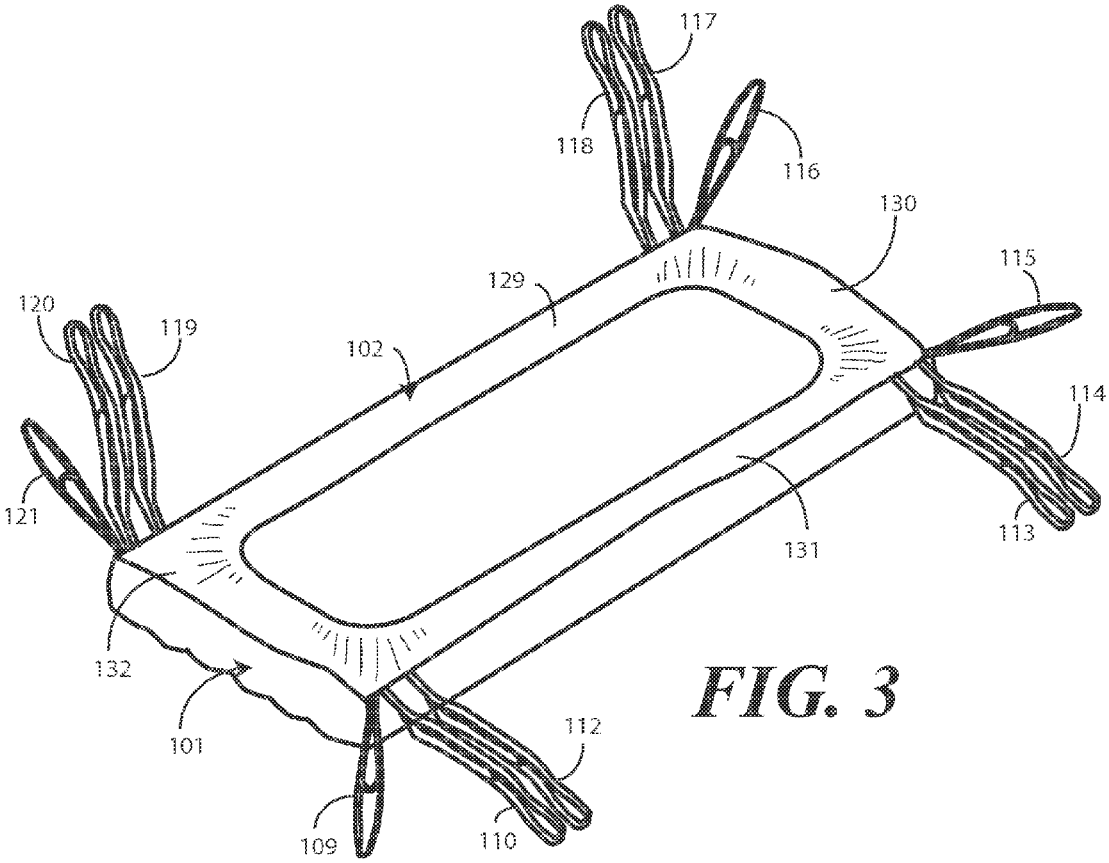
FIG. 3 illustrates one explanatory patient transport device in accordance with one or more embodiments of the disclosure.

Turning now to FIG. 3, the strap concealment device 120 has been attached to the inflatable torso support 101. The inflatable torso support 101 has been inflated in this embodiment. The one or more side panels 129,130,131,132 are folded to the second position 136. Accordingly, both the inflatable torso support 101 and the one or more straps 109,110,112, 113,114,115,116,117,118,119,120,121 are exposed. A health care services provider can thus freely grasp the one or more straps 109,110,112,113,114,115,116, 117,118,119,120,121 to either attach them to a lift or to carry the patient manually.

Figure 4:
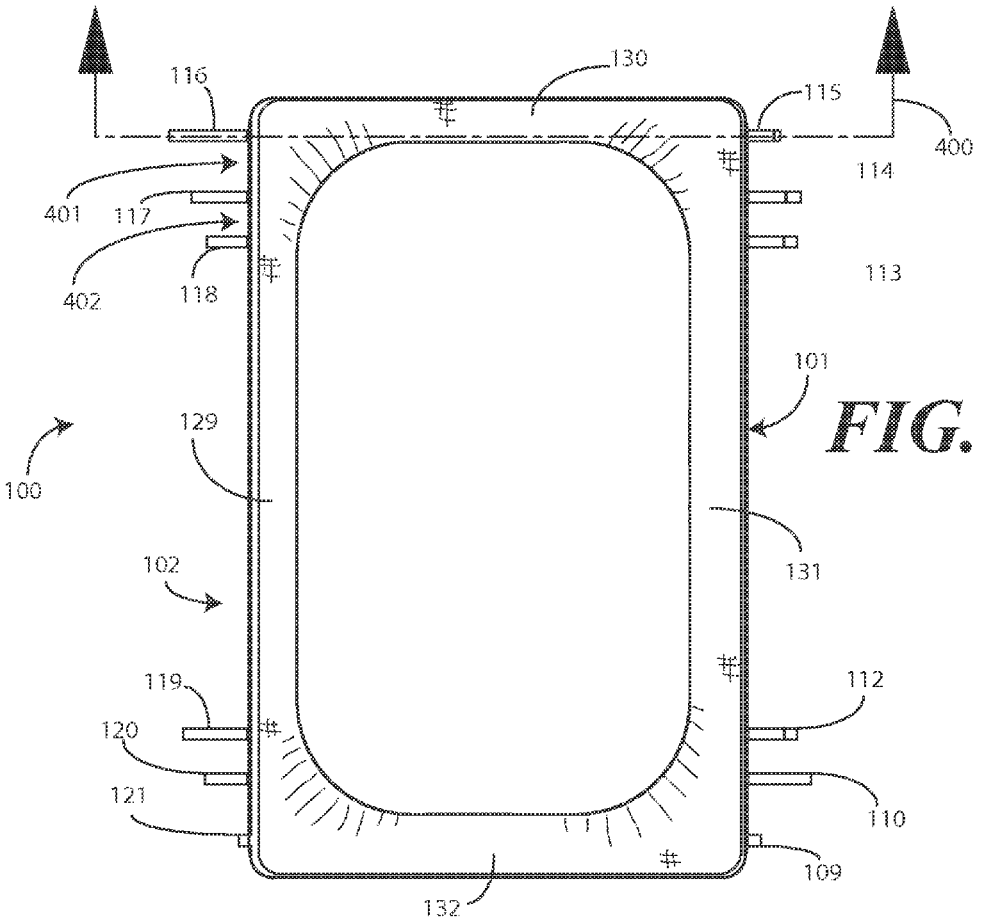
FIG. 4 illustrates one explanatory patient transport device in accordance with one or more embodiments of the disclosure.
Figure 5:
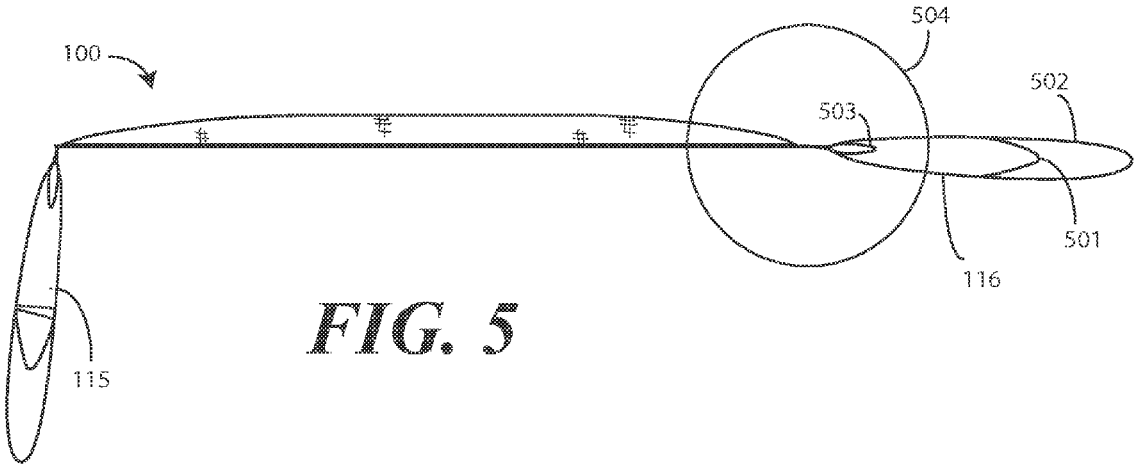
FIG. 5 illustrates one explanatory patient transport device in accordance with one or more embodiments of the disclosure.

FIG. 4 illustrates the assembled patient transport device 100 in a top plan view. The inflatable torso support (101) has been deflated in this embodiment. The one or more side panels 129,130,131,132 are folded to the first position (135). Accordingly, both the inflatable torso support (101) and the one or more straps 109,110,112, 113,114,115,116,117,118, 119,120,121 are exposed. This view also shows that, in one embodiment, the perimeter 133 of the central panel 128 of the strap concealment device 102 can have a rectangular shape in one or more embodiments. FIG. 4 includes a sectional line 400 cut across a width of the patient transport device 100 through straps 115,116. FIG. 5 shows the sectional view cut across this sectional line 400.

Turning to FIG. 5, the sectional view of the patient transport device 100 is shown from a side elevation view. In this illustrative embodiment, straps 115,116 are configured with three loops rather than two. For example, strap 116 includes a first loop 501 disposed interior to a second loop 502, and a third loop 503 disposed interior to the first loop 501. This is simply for illustration to highlight the many different ways in which the straps of embodiments of the disclosure can be configured.

Figure 6:
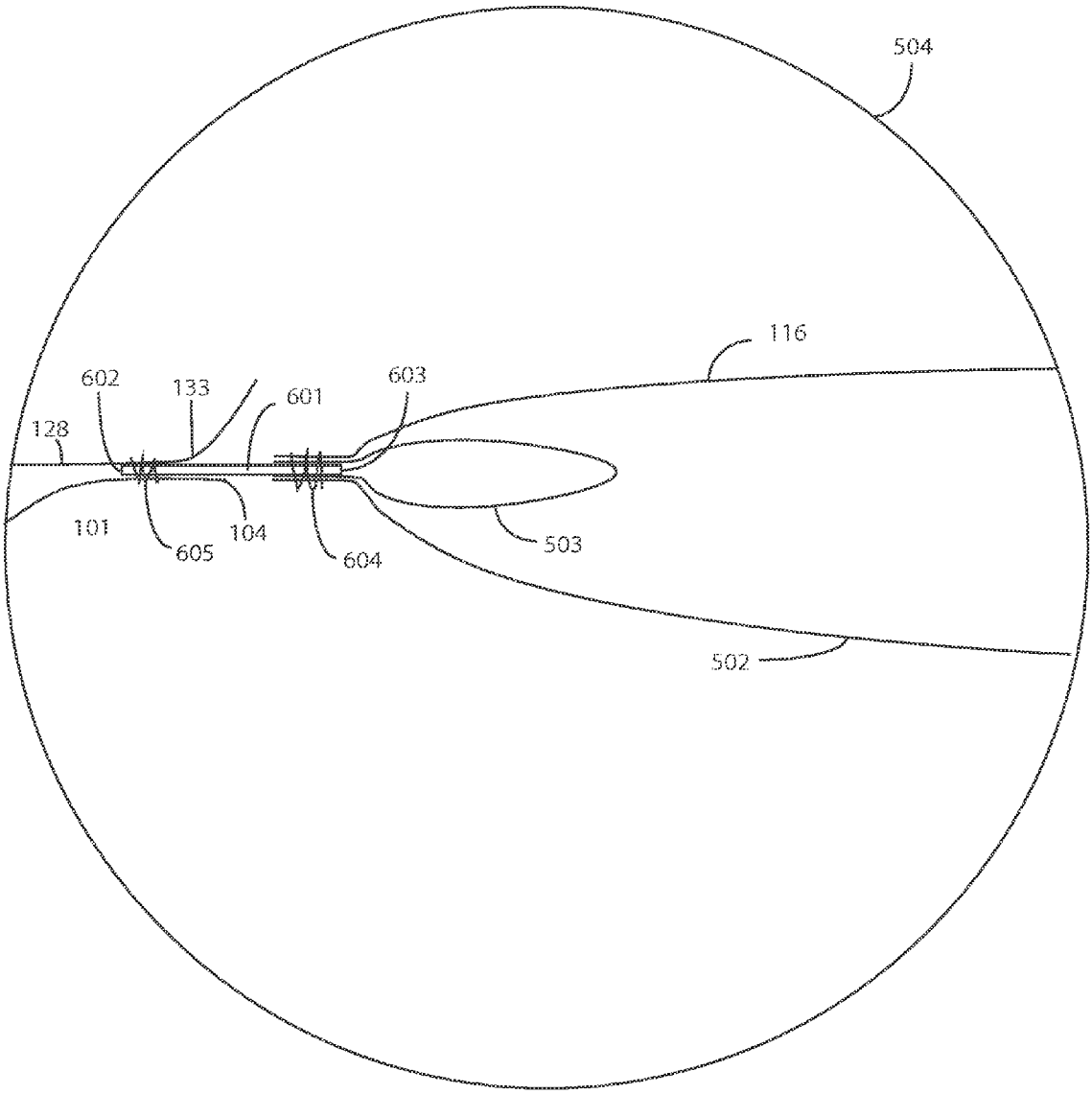
FIG. 6 illustrates one explanatory coupling between one or more straps and a patient transport device in accordance with one or more embodiments of the disclosure.

A sectional circle 504 is shown in FIG. 5. A magnified view of this sectional circle 504 is shown in FIG. 6. Turning now to FIG. 6, illustrated therein is an alternate coupling scheme for the strap 116, strap concealment device 102, and inflatable torso support 101.

In one embodiment, the patient transport device (100) includes one or more linkage members coupling the one or more straps (109,110,112, 113,114,115,116,117,118,119, 120,121) to the inflatable torso support 101. One such linkage member 601 is shown in FIG. 6.

In one embodiment, the one or more linkage members couple the one or more straps (109,110,112, 113,114,115), 116,(117,118,119,120,121) to the inflatable torso support 101 on a one-to-one basis. Thus, as shown in FIG. 6, a single linkage member 601 couples a single strap 116 to the inflatable torso support 101. In other embodiments, a single linkage member can span one or more straps. Accordingly, each of straps 116,(117,118) could be attached to a single linkage member in one or more embodiments.

In one embodiment, the linkage members each comprise a strip of woven synthetic webbing. For example, the linkage member 601 of FIG. 6 may be a woven nylon or polyester webbing in one embodiment. In other embodiments, the linkage members can be formed from a single-ply or multi-ply organic or synthetic woven fabric. In one embodiment, each linkage member has a width of between one and four inches so as to sustain the loading that occurs when a patient is lifted by the straps. Reinforcing members, such as woven metallic devices, can be included with the linkage member 601 to reinforce the same and/or increase stiffness.

As shown in FIG. 6, in one embodiment, a first end 602 of the linkage member 601 is coupled between the perimeter 133 of the central panel 128 of the strap concealment device 102 and a side 104 of the inflatable torso support 101. A second end 603 of the linkage member 601 is then coupled to at least one loop 502,503 of one strap 116 of the one or more straps (109,110, 112,113,114,115),116,(117,118,119, 120,121) of the patient transport device (100). In the illustrative embodiment of FIG. 6, both the second loop 502 and the third loop 503 are coupled to the second end 603 of the linkage member 601. In one embodiment, these loops 502, 503 are coupled to the linkage member 601 by stitching 604. Similarly, in one embodiment the first end 602 of the linkage member 601 is coupled between the perimeter 133 of the central panel 128 and the side 104 of the inflatable torso support 101 by stitching 605. However, it should be noted that other coupling techniques such as thermal bonding or rivets might also be used. Still other coupling methods will be obvious to those of ordinary skill in the art having the benefit of this disclosure.

In one embodiment, in addition to being coupled to the linkage member 601, the perimeter 133 of the strap concealment device 102 can be coupled to the outer surface of the inflatable torso support 101 as well. Accordingly, where this is the case, the entire perimeter 133 of the strap concealment device 102 will be coupled something, be it the inflatable torso support 101 or the one or more linkage members. However, in other embodiments, the perimeter 133 of the central panel 128 is coupled to the inflatable torso support 101 only by coupling portions of the perimeter 133 to the first end 602 of each linkage member 601. This thereby defines openings between the perimeter 133 of the central panel 128 and the side 104 of the inflatable torso support 101 between the one or more linkage members. Turning briefly back to FIG. 4, this will be explained in more detail.

Where the perimeter 133 of the central panel 128 of the strap concealment device 102 is coupled to the inflatable torso support 101 only at the linkage members attached to each strap 109,110,112, 113,114,115,116,117,118,119,120, 121, openings 401,402 will be defined between each linkage member. Thus, there would be an opening 401 between the strap concealment device 102 and the inflatable torso support 101 between, for example strap 116 and strap 117. A person could insert the straps into this opening 401 to dispose the strap between the strap concealment device 102 and the inflatable torso support 101.

Figure 7:
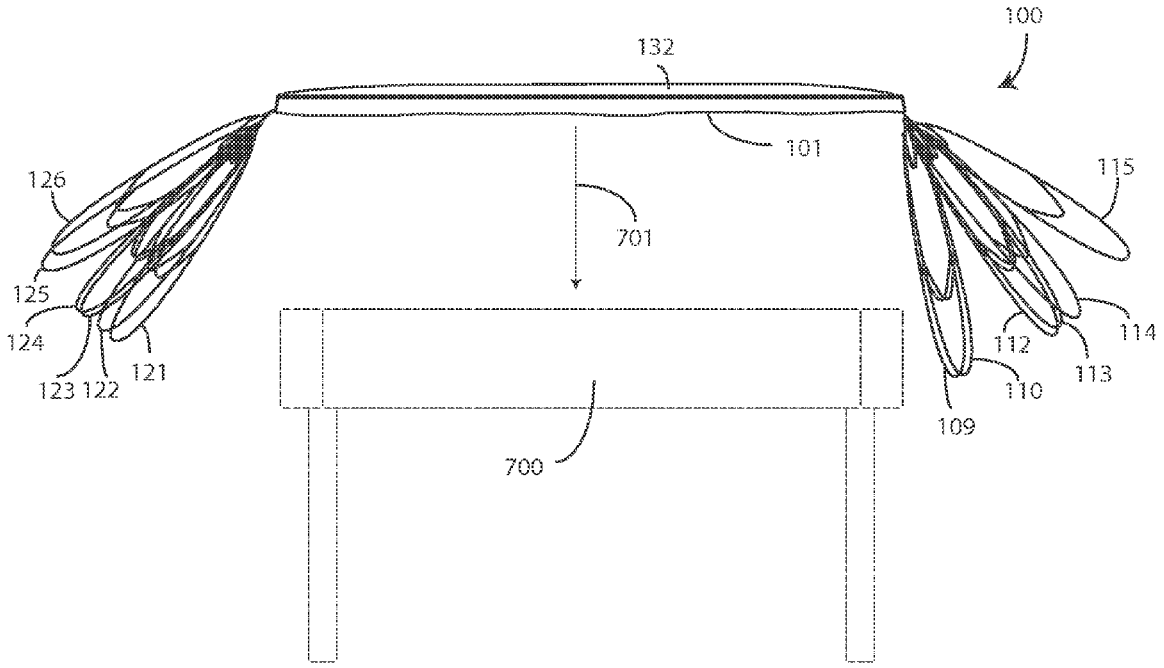
FIG. 7 illustrates an explanatory method step of using one explanatory patient transport device in accordance with one or more embodiments of the disclosure.

Turning now to FIGS. 7-14 illustrated therein is one embodiment of a patient transport device 100 in use. Beginning with FIG. 7, the patient transport device 100 is placed 701 upon a support surface 700. The support surface 700 could be a bed, operating table, gurney, stretcher, or other device upon which a patient may lay. As shown in FIG. 7, the one or more side panels (129,130,131),132 are folded to the second position (136). Accordingly, both the inflatable torso support 101 and the one or more straps 109,110,112, 113,114,115,116,117,118,119,120,121 are exposed.

Figure 8:
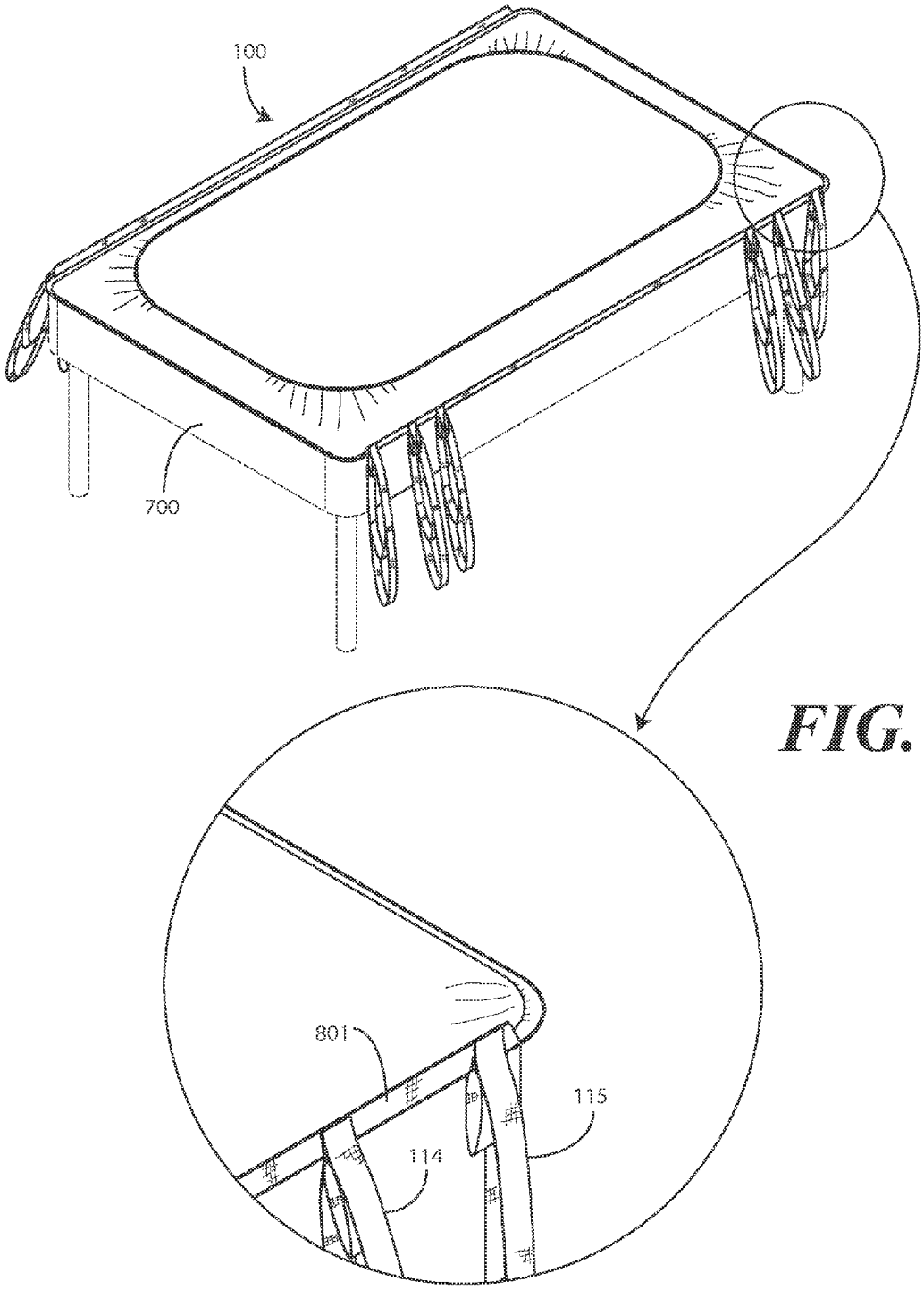
FIG. 8 illustrates one explanatory patient transport device in accordance with one or more embodiments of the disclosure.

FIG. 8 illustrates a perspective view of the patient transport device 100 once disposed on the support surface 700. Recall from above that in one embodiment, one or more linkage members couple the one or more straps to the inflatable torso support on a one-to-one basis, as was shown in FIG. 6. In the embodiment of FIG. 8, to show how embodiments of the disclosure can be varied, a single linkage member 801 spans a plurality of straps 114,115. Accordingly, each of the straps 114,115 is attached to a single linkage member 801 in this embodiment.

Figure 9:
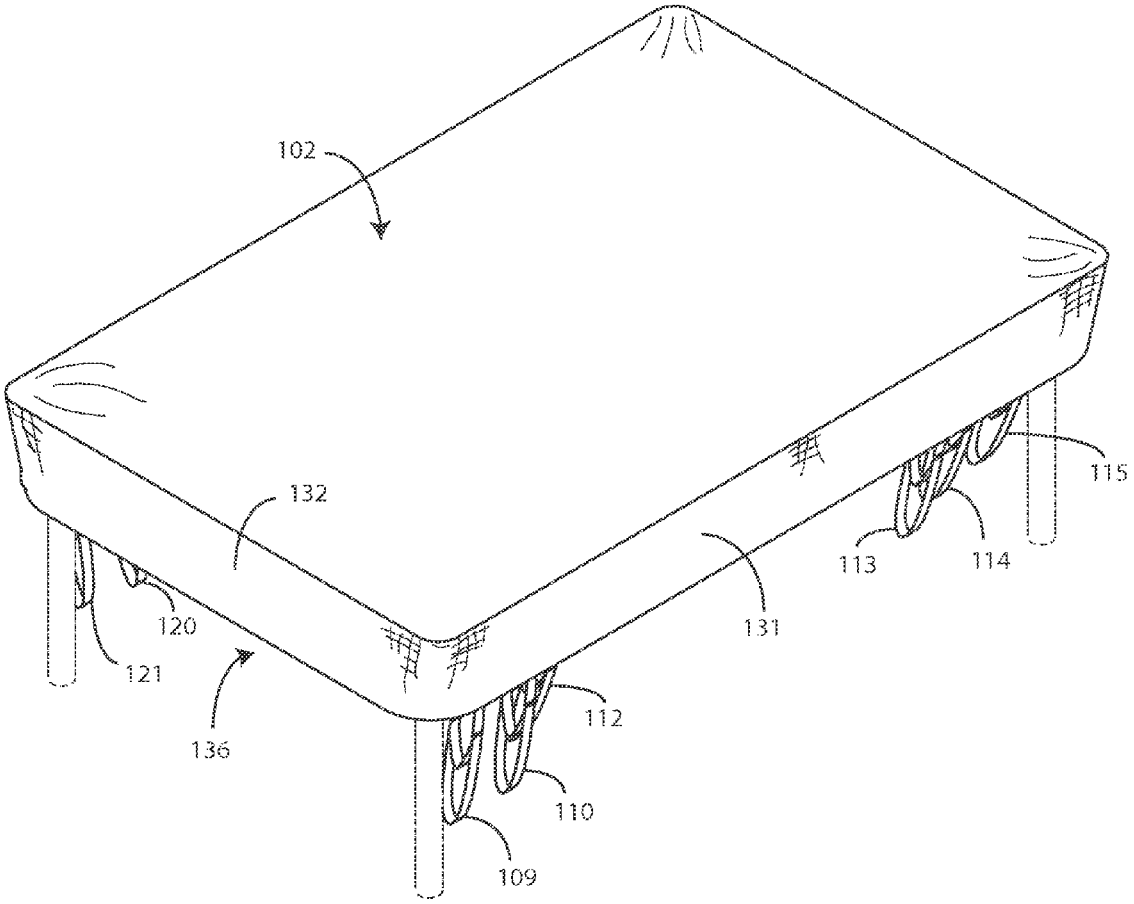
FIG. 9 illustrates another explanatory method step of using one explanatory patient transport device in accordance with one or more embodiments of the disclosure.

Turning to FIG. 9, the one or more side panels (129,130), 131,132 have been folded to the second position 136. As shown in this figure, when in the second position 136, the one or more side panels (129,130),131,132 conceal the inflatable torso support (101). The one or more side panels (129,130),131,132 also conceal at least a portion of the straps 109,110,112,113,114,115, (116,117,118,119),120,121. The straps 109,110,112,113,114,115,(116,117,118,119),120, 121 are only partially concealed because they were left hanging about the support surface (700) when the one or more side panels (129,130),131,132 were been folded to the second position 136. Had the straps 109,110,112,113,114, 115,(116,117,118,119),120,121 been tucked either under the inflatable torso support (101) or between the strap concealment device 102 and the inflatable torso support (101), the one or more side panels (129,130),131,132 would have completely concealed both the inflatable torso support (101) and the straps 109,110,112,113,114,115,(116,117,118,119), 120, 121. Other concealment configurations will be obvious to those of ordinary skill in the art having the benefit of this disclosure.

As can be seen in FIG. 9, folding the one or more side panels (129,130),131,132 to the second position 136 advantageously provides an aesthetically pleasing appearance for a patient. Rather than seeing a potentially frightening set of connectors and other implements, the patient sees the strap concealment device 102, which in this embodiment resembles conventional bedding. Moreover, the patient has a comfortable place to lie down as the strap concealment device 102, in one embodiment, the hand of cotton textiles as noted above. Another advantage of employing the strap concealment device 102 as shown in FIG. 9 is that the patient is no longer at risk of getting their fingers, toes, arms caught in the straps 109,110,112,113,114,115,(116,117, 118, 119),120,121. At the same time, all a health care services provider needs to do to easily move the patient is inflate the inflatable torso support (101). Similarly, of the health care services provider wants to move the patient, they simply fold the one or more side panels (129,130),131,132 to the first position (135) to access the straps 109,110,112,113,114,115, (116, 117,118,119),120,121.

Figure 10:
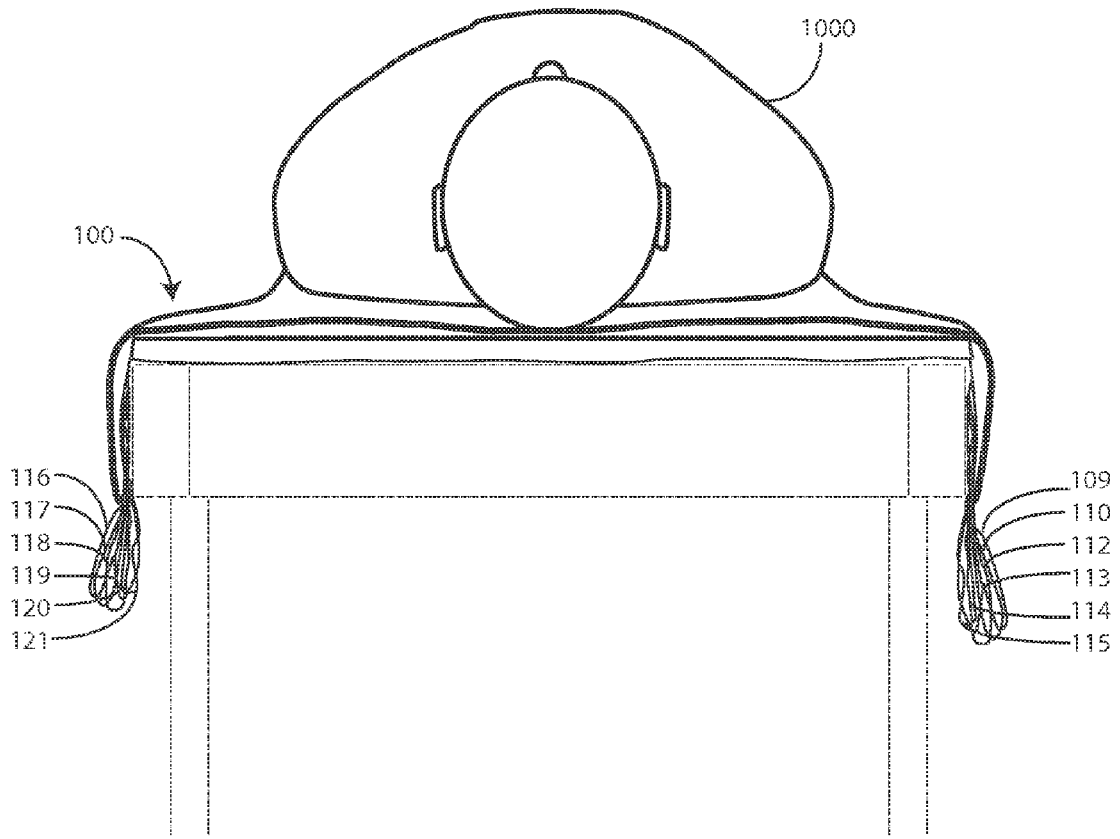
FIG. 10 illustrates one explanatory patient transport device in accordance with one or more embodiments of the disclosure in use.

Turning now to FIG. 10, a patient 1000 named Buster is shown lying atop the patient transport device configured as it was in FIG. 9. As shown, exposed portions of the straps 109,110,112,113,114, 115,116,117,118,119,120,121 are far away from the patient 1000 and are not available for catching fingers, arms, toes, or legs. Accordingly, the patient 1000 can rest comfortably.

Figure 11:
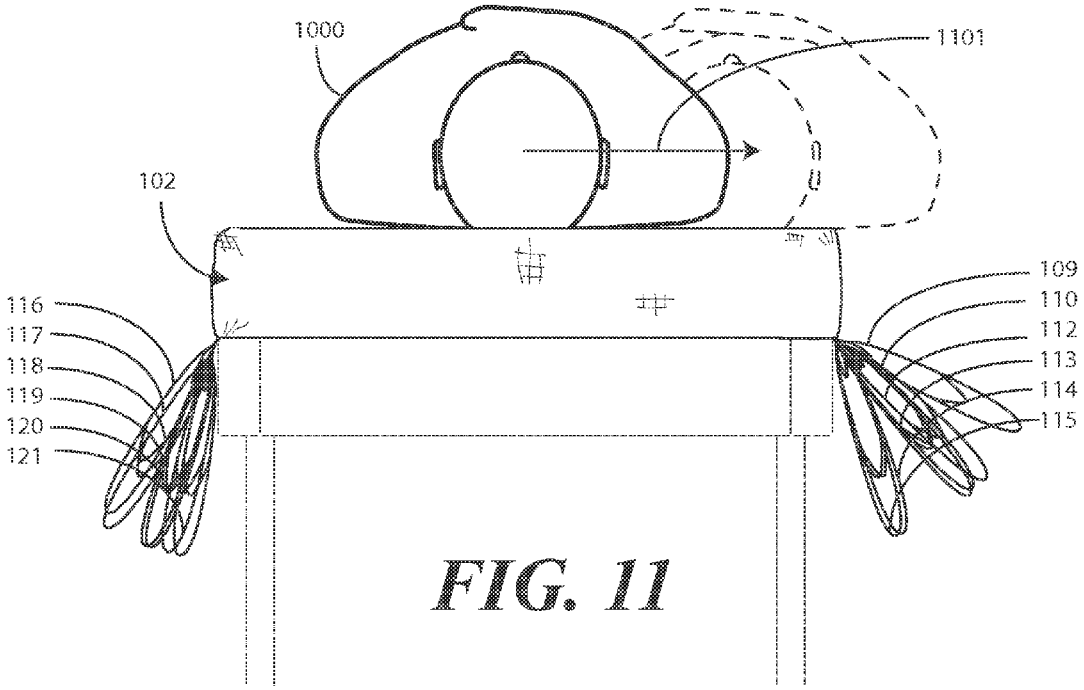
FIG. 11 illustrates another explanatory method step of using one explanatory patient transport device in accordance with one or more embodiments of the disclosure.

Turning to FIG. 11, the inflatable torso support (101) has been inflated. The strap concealment device 102 still conceals the inflatable torso support (101), but the straps 109, 110,112,113,114,115,116,117,118,119,120,121 are now exposed in this configuration. Recall from above that in one or embodiments a friction reducing coating can be disposed along, or integrated in, the outer surface of the inflatable torso support (101). This allows the patient 1000 to be moved 1101 laterally with ease.

Figure 12:
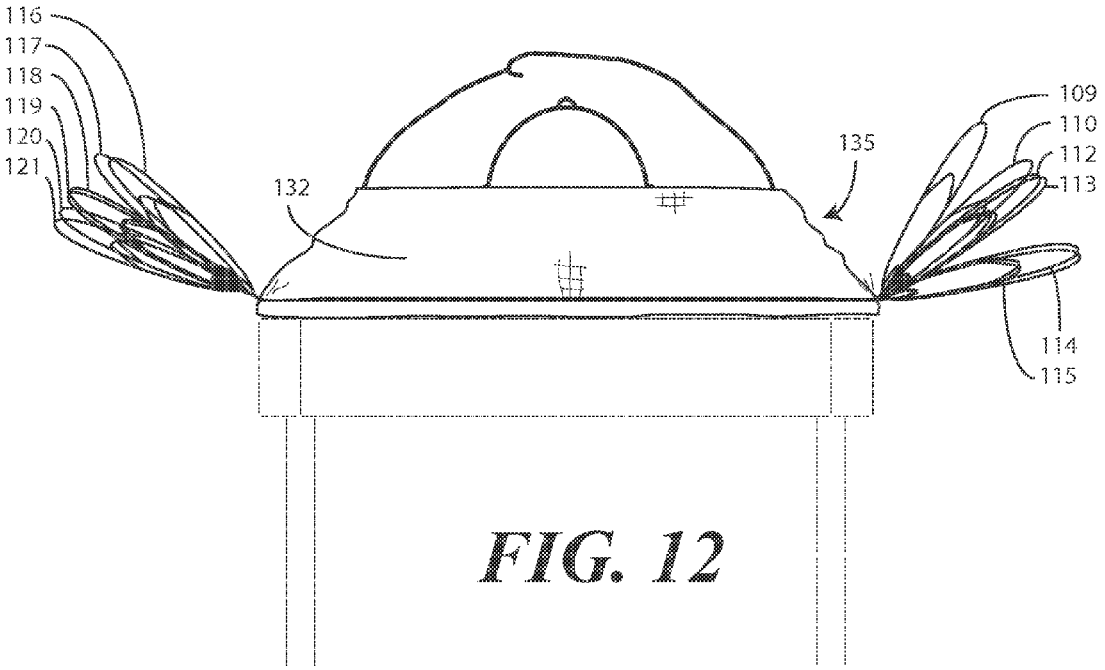
FIG. 12 illustrates yet another explanatory method step of using one explanatory patient transport device in accordance with one or more embodiments of the disclosure.
Figure 13:
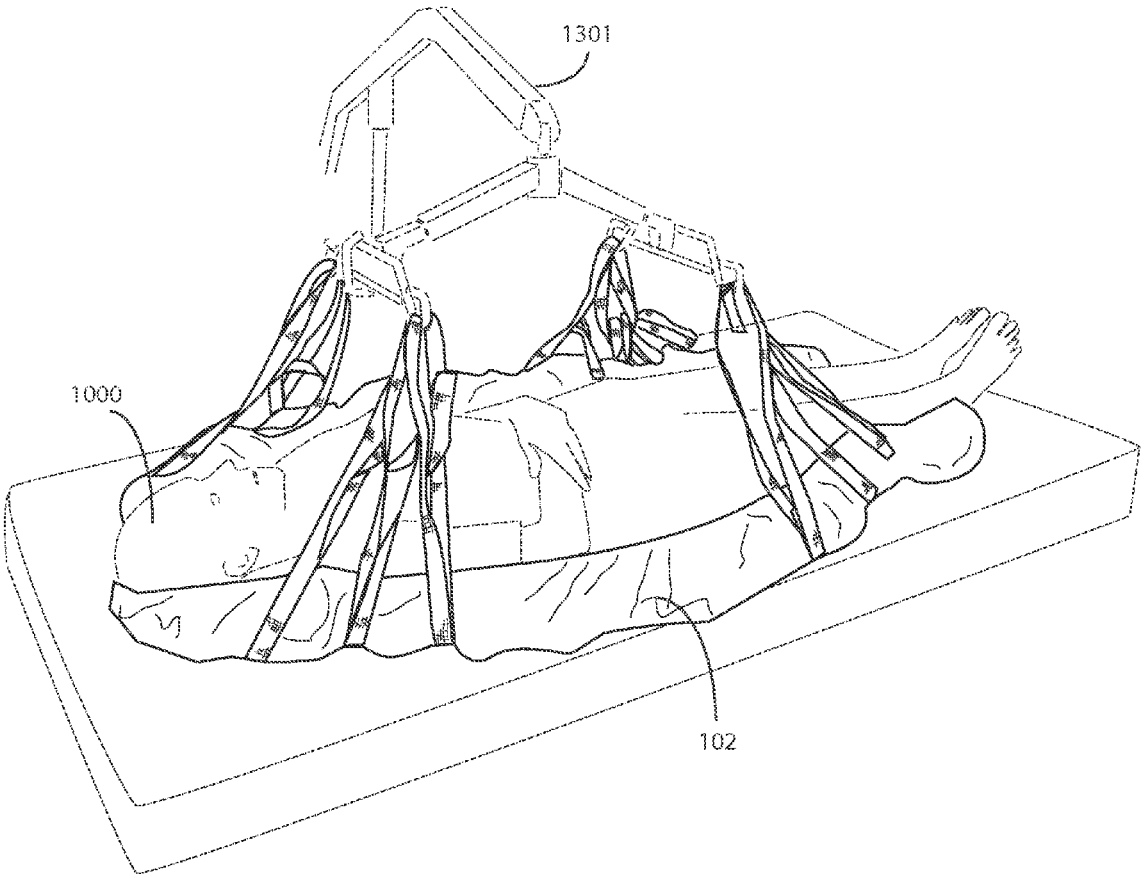
FIG. 13 illustrates yet another explanatory method step of using one explanatory patient transport device in accordance with one or more embodiments of the disclosure.
Figure 14:
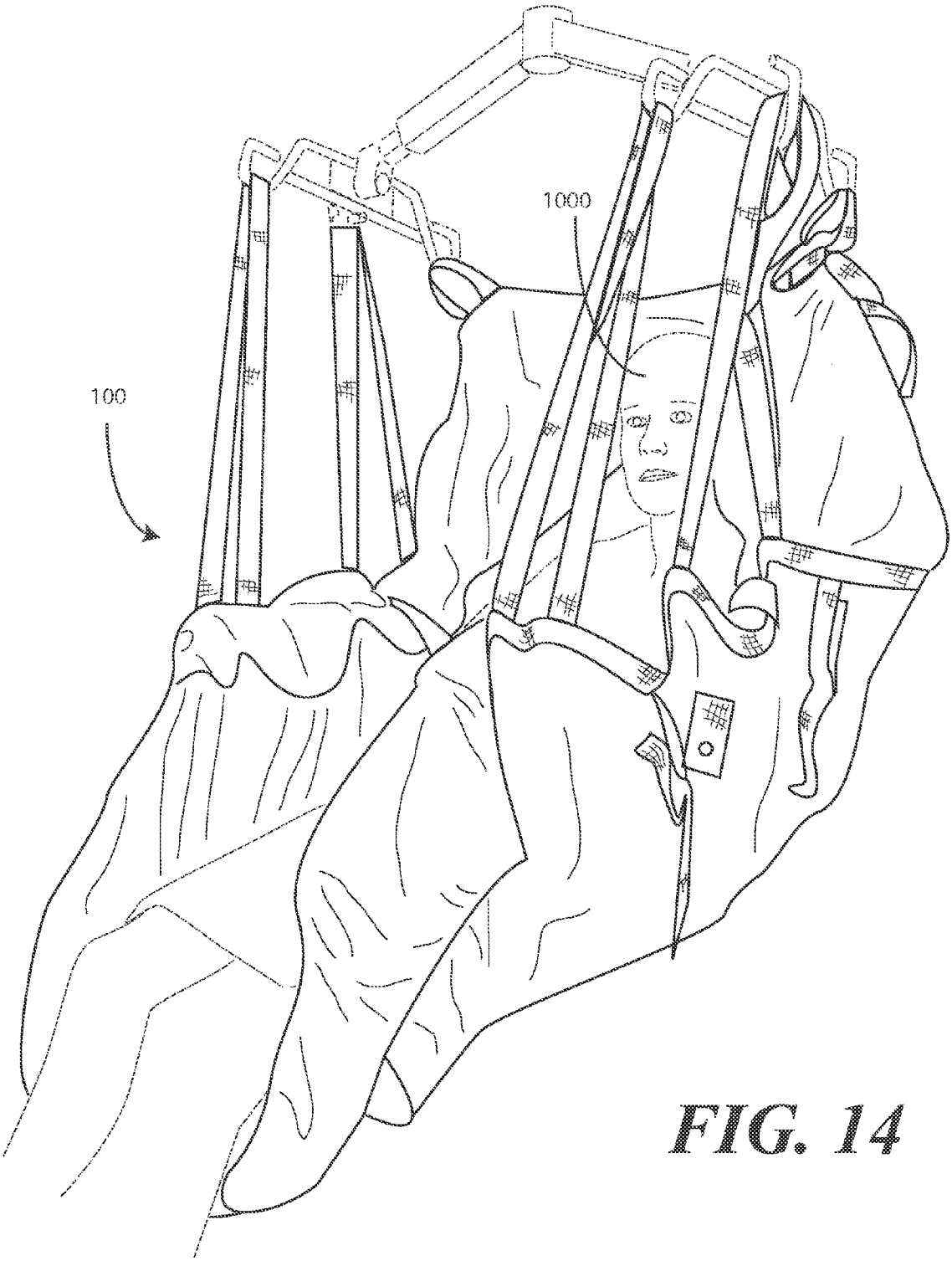
FIG. 14 illustrates still another explanatory method step of using one explanatory patient transport device in accordance with one or more embodiments of the disclosure.

In FIG. 12, the one or more side panels (129,130,131),132 have been folded to the first position 135. As shown in this figure, when in the first position 135, the one or more side panels (129,130,131),132 reveal both the inflatable torso support 101 (which is deflated in this figure) and the straps 109,110,112,113,114,115,116,117,118,119,120,121. Accordingly, a health care services provider can easily access the straps 109,110,112,113,114,115,116,117,118,119,120,121. As shown in FIG. 13, the straps 109,110,112,113,114,115, 116,117,118,119,120,121 can then be attached to a lift 1301. The strap concealment device 102 advantageously gently cradles the patient 1000, thereby preventing burns or abrasions from portions of the straps 109,110,112,113, 114,115, 116,117,118,119,120,121 touching the skin. The strap concealment device 102 provides a caressing cocoon in which the patient 1000 may ride during transport. The patient 1000 is being transported by the patient transport device 100 in FIG. 14.

Figure 15:
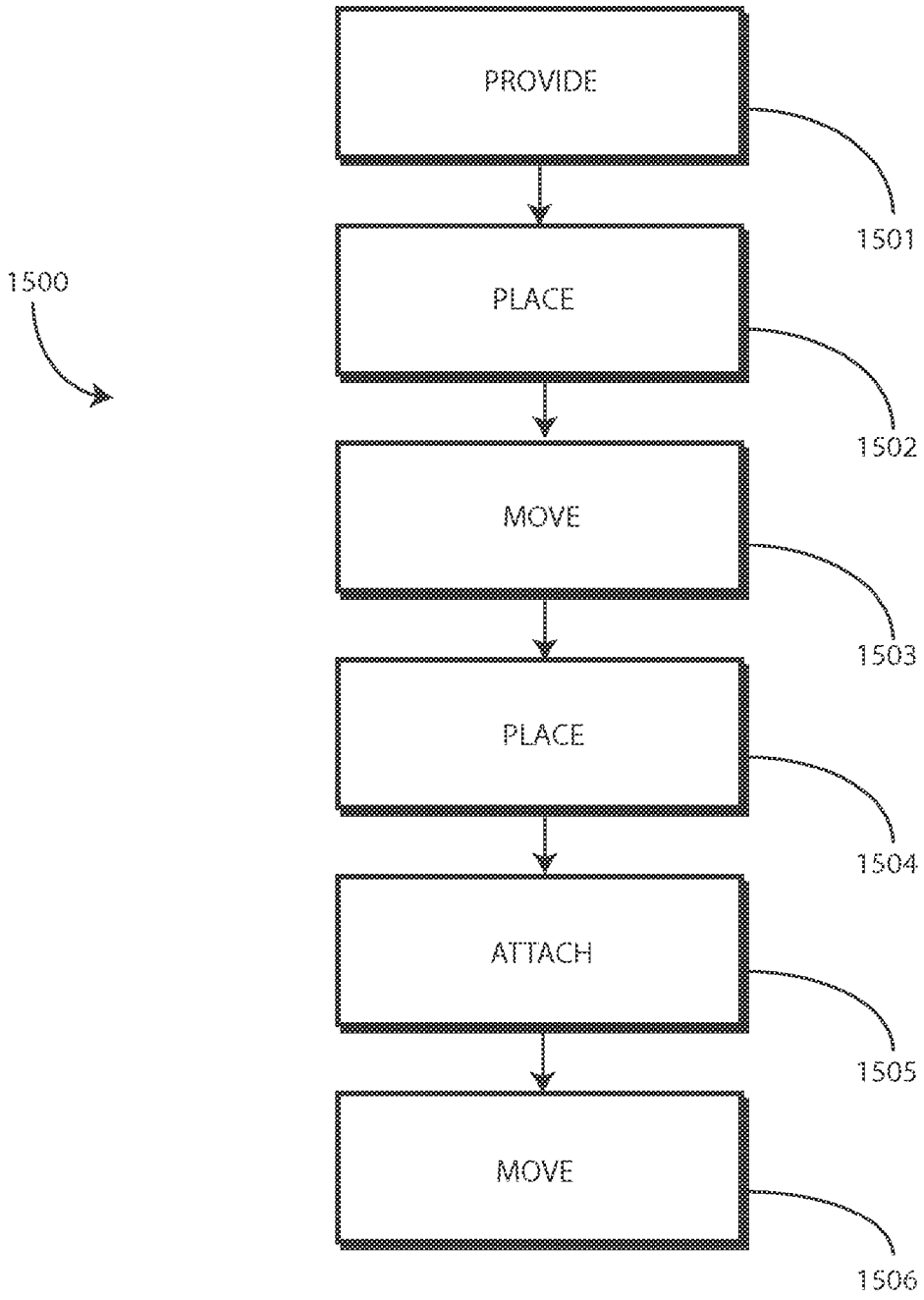
FIG. 15 illustrates an explanatory method in accordance with one or more embodiments of the disclosure.

While the method steps of using the patient transport device have largely been described above, FIG. 15 illustrates a flow chart showing one explanatory method 1500 of using a patient transport device configured in accordance with one or more embodiments of the disclosure.

At step 1501, the method 1500 provides a patient transport device. In one embodiment, the patient transport device comprises an inflatable torso support and one or more straps coupled to the inflatable torso support. In one embodiment, each strap is configured at least as a single loop. In one embodiment, the patient transport device includes a strap concealment device coupled to the inflatable torso support. In one embodiment, the strap concealment device is configured as a fitted sheet and comprises a central panel and one or more side panels extending from the central panel and terminating at an elastic binding.

At step 1502, the method 1500 includes placing the patient transport device on a surface. In one embodiment, the surface is a bed. In another embodiment, the surface is an operating table. In another embodiment, the surface is a stretcher. In yet another embodiment, the surface is a gurney. Other surfaces suitable for supporting the patient transport device will be obvious to those of ordinary skill in the art having the benefit of this disclosure.

At step 1503, the method 1500 optionally includes moving the one or more side panels to a first position concealing the inflatable torso support and at least a portion of the one or more straps. At step 1504, the method 1500 optionally includes transitioning the one or more side panels to a second position exposing the inflatable torso support and the one or more straps. It should be noted that at any time in the method 1500, step 1503 and step 1504 can be repeated as necessary to achieve the configuration desired by a patient or health care services provider.

At step 1505, the method 1500 includes attaching the one or more straps to a lift. At step 1506, the method 1500 includes moving a patient with the patient transport device. Step 1506 can optionally include the steps of inflating the inflatable torso support and sliding a patient along a major face of the patient transport device. These steps can come before or after step 1505 and the moving of the patient with the lift occurring at step 1506.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A patient transport device, comprising:
an inflatable torso support;
one or more straps coupled to sides of the inflatable torso support, each strap configured at least as a single loop; and
a strap concealment device stitched, bonded or riveted to the inflatable torso support and spanning a major face of the inflatable torso support, the strap concealment device comprising:
a central panel spanning the major face; and
one or more side panels extending from a perimeter of the central panel;
the one or more side panels terminating at a bunch-gathering binding;
the one or more side panels selectively foldable between:
a first position concealing the inflatable torso support and at least a portion of the one or more straps; and
a second position exposing the inflatable torso support and the one or more straps.

2. The patient transport device of claim 1, further comprising one or more linkage members coupling the one or more straps to the inflatable torso support.

3. The patient transport device of claim 2, the one or more linkage members coupling the one or more straps to the inflatable torso support on a one-to-one basis.

4. The patient transport device of claim 3, a first end of the one or more linkage members coupled between the perimeter of the central panel and a side of the inflatable torso support.

5. The patient transport device of claim 4, a second end of the one or more linkage members coupled to at least one loop of one strap of the one or more straps.

6. The patient transport device of claim 5, the at least one loop comprising two loops, with a first loop disposed interior to a second loop.

7. The patient transport device of claim 6, the first loop and the second loop color-coded with the first loop having a different color than the second loop.

8. The patient transport device of claim 6, both the first loop and the second loop attached to the second end of the each linkage member.

9. The patient transport device of claim 8, the first loop and the second loop attached to the second end of the each linkage member by stitching.

10. The patient transport device of claim 5, the at least one loop comprising three loops, with a first loop disposed interior to a second loop and a third loop disposed interior to the first loop.

11. The patient transport device of claim 4, the perimeter of the central panel coupled to the inflatable torso support only by coupling portions of the perimeter to the first end of the one or more linkage members thereby defining openings between the perimeter of the central panel and an edge of the inflatable torso support between the one or more linkage members.

12. The patient transport device of claim 4, the first end of the one or more linkage members coupled between the perimeter of the central panel and an edge of the inflatable torso support by stitching.

13. The patient transport device of claim 4, the one or more linkage members comprising a strip of woven synthetic webbing.

14. The patient transport device of claim 1, the inflatable torso support and the perimeter of the central panel configured in a substantially rectangular shape, the one or more straps comprising a plurality of straps, with three straps positioned proximally at each corner of the substantially rectangular shape.

15. The patient transport device of claim 1, the bunch-gathering binding comprising an elastic binding coupled to the one or more side panels.

16. A method, comprising:
providing a patient transport device comprising:
an inflatable torso support;
one or more straps coupled to the inflatable torso support, each strap configured at least as a single loop; and
a strap concealment device stitched, bonded or riveted to the inflatable torso support, the strap concealment device comprising a central panel and one or more side panels extending from the central panel and terminating at an elastic binding;
placing the patient transport device on a surface; and
moving the one or more side panels to a first position concealing the inflatable torso support and at least a portion of the one or more straps.

17. The method of claim 16, further comprising transitioning the one or more side panels to a second position exposing the inflatable torso support and the one or more straps.

18. The method of claim 17, further comprising attaching the one or more straps to a lift.

19. The method of claim 18, further comprising moving a patient with the patient transport device.

20. The method of claim 16, further comprising:
inflating the inflatable torso support; and
sliding a patient along a major face of the patient transport device.

* * * * *